313-428 SR
8/7/84 XR 4,464,643

United States Patent [19]
Meershoek

[11] Patent Number: 4,464,643
[45] Date of Patent: Aug. 7, 1984

[54] DEVICE FOR DISPLAYING TELEVISION PICTURES AND DEFLECTION UNIT THEREFOR

[75] Inventor: Hans Meershoek, Eindhoven, Netherlands

[73] Assignee: U.S. Philips Corporation, New York, N.Y.

[21] Appl. No.: 474,867

[22] Filed: Mar. 14, 1983

[30] Foreign Application Priority Data

Jan. 6, 1983 [NL] Netherlands ..... 8300031

[51] Int. Cl.[3] ..... H01F 5/00
[52] U.S. Cl. ..... 335/213; 335/210; 313/428
[58] Field of Search ..... 335/210, 213; 313/426, 313/427, 428

[56] References Cited

U.S. PATENT DOCUMENTS 3,735,193 5/1973 Ikeuchi ..... 335/213 X
4,078,301 3/1978 Renders et al. ..... 335/213 X
4,143,346 3/1979 Borkar et al. ..... 335/213

*Primary Examiner*—Harris George
*Attorney, Agent, or Firm*—Thomas A. Briody; William J. Streeter

[57] ABSTRACT

A device for displaying television pictures comprising a display tube in the neck of which an electron gun system is present for emitting at least one electron beam towards a display screen and having a deflection unit which is connected coaxially around the display tube and comprising a line deflection coil system and a frame deflection coil system both having coils of the saddle type. Each frame deflection coil comprises a number of conductors which are wound so as to produce first and second side packets, a first front end section and a second front end section which together define a first window, as well as to produce third and fourth side packets, a second rear end section and a second front end section which together define a second window which is situated within the first window.

10 Claims, 19 Drawing Figures

DEVICE FOR DISPLAYING TELEVISION PICTURES AND DEFLECTION UNIT THEREFOR

The invention relates to a device for displaying television pictures comprising a display tube in the neck of which an electron gun system is present for emitting at least one electron beam towards a display screen, and comprising a deflection unit which is connected coaxially around the display tube. The deflection unit comprises a line deflection coil system which upon energization deflects the electron beam(s) in a first direction and a frame deflection coil system which upon energization deflects the electron beam(s) in a direction transverse to the first direction. The frame deflection coil system comprises two frame deflection coils of the saddle type situated diametrically with respect to each other, each frame deflection coil comprising a number of conductors which are wound so as to produce first and second side packets extending in the longitudinal direction of the deflection unit, an arc-shaped first front end section and an arc-shaped first rear end section which together define a first window.

BACKGROUND OF THE INVENTION

In monochrome display tubes the electron gun system is designed to generate one electron beam, whereas in colour display tubes of the in-line type the electron gun system is designed to generate three coplanar electron beams which convergence on the display screen.

The deflection unit for deflecting the electron beams which is placed around the display tube is used to deflect the electron beams from their normal undeflected straight path in one or in the other direction so that the beams impinge upon selected points of the display screen so as to provide visual indications thereon. By varying the magnetic deflection fields in a suitable manner the electron beams can be moved upwards or downwards and to the left or to the right over the (vertically disposed) display screen. By simultaneously varying the intensity of the beams a visual presentation of information or a picture can be formed on the display screen. The deflection unit connected around the neck portion of the display tube comprises two deflection coil systems so as to be able to deflect the electron beams in two directions which are transverse to each other. Each system comprises two coils which are placed on oppositely located sides of the tube neck, the systems being moved relative to each other 90° around the tube neck. When the two deflection coil systems are energized they produce orthogonal deflection fields.

Essentially the fields are at right angles to the path of the undeflected electron beams. A cylindrical core of magnetisable material which may tightly fit around the deflection coil systems when the deflection coil systems are both of the saddle type, is usually used to concentrate the deflection fields and to increase the flux density in the deflection area.

In order to meet certain requirements as regards the picture quality, the (dynamic) magnetic deflection fields should often be modulated strongly. For example, the more and more stringent requirements as regards the convergence in three-in-line colour television systems necessitate, in addition to a strong negative magnetic sixpole component in the central area of the frame deflection field, a strong positive magnetic sixpole component on the gun side of the frame deflection field. The strong positive sixpole component is necessary for coma correction. (The effect of a positive sixpole component on the dipole deflection field is a pincushion-shaped field variation). For a self-convergent in-line colour system having green as the central beam and red and blue as the outer beams, coma is to be understood to mean: a vertical shift from red and blue with respect to green. When no coma correction measures are taken, red and blue will be deflected more strongly than green. In a pincushion-shaped deflection field on the gun side, red and blue experience a weaker deflection field than green. As a result of this, red and blue will be deflected less strongly.

Display devices of the kind discussed above comprise frame deflection coils of the saddle type. These are self-supporting coils which comprise a number of conductors which are wound so as to produce first and second side packets, an arc-shaped first end section and an arc-shaped second end section which together define a window. In such coils the rear end sections (on the gun side) may be directed upwards with respect to the profile of the display tube (the original type of saddle coil) or be directed downwards (in this type of saddle coil the rear end section, as it were, follows the tube profile).

A pincushion-shaped field is generated when the window apertures of the two saddle coils of a deflection coil system are large, a barrel-shaped field is generated when the window apertures are small. For a self-converging system the frame deflection field in the central area must have a barrel-shaped distribution (the individual saddle frame deflection coils must thus have a small window aperture), on the gun side it must have a pincushion-shaped distribution (large window aperture) and on the cup side it must have a homogeneous or more or less pincushion-shaped distribution dependent on the fact how much east-west frame distortion is to be permitted. Such field distributions are also of importance for monochrome display tubes/deflection unit systems which are to have a high resolving power.

It has so far not proved possible to make saddle coils having a window aperture which varies as strongly as is desired for the said applications while using the currently used winding methods. On the other hand, several compromise solutions are known to make the problem less great. For example, a less large window than is in fact necessary will suffice on the gun side by intensifying the pincushion shape of the frame deflection field at the area by means of segments of soft-magnetic metallic material placed in the frame deflection field. However, from an energetic point of view the use of such segments is undesired.

OBJECT OF THE INVENTION

It is the object of the invention to provide in particular a coil design for a display system of the kind as described above which results in the generation of a frame deflection field having the field shape which is desired with respect to self-convergence and east-west distortion without this requiring additional auxiliary means, that is to say at least on the gun side.

SUMMARY OF THE INVENTION

For that purpose, a display device having a display tube and a deflection unit of the kind as described above is characterized in that each frame deflection coil comprises further conductors which are wound so as to produce third and fourth side packets, an arc-shaped second front end section and an arc-shaped second rear end section which together define a second window which lies within the first window.

In principle, the above-described coil design consists of coils having two sets of packets of turns which on the gun side have different lengths. The outermost packet having a larger window aperture extends farthest on the gun side, as a result of which a pincushion-shaped field is generated on the gun side.

The inner packet of turns, on its gun side, has a smaller window aperture, as a result of which the assembly does not generate a pincushion-shaped field in the central area of the deflection field, but generates a stronger or less-strong barrel-shaped field. Said smaller window aperture widens in the direction of the display screen in order to generate a homogeneous or a stronger or less strong pincushion-shaped deflection field on the screen side of the deflection field. This latter depends on the extent of widening.

According to a preferred embodiment of the invention the central part of the first rear end section is situated closer to the second rear end section than the parts adjoining the central part. In this manner two loop-shaped segments are formed at the ends of the side packets which, in particular when they centre about radial positions of substantially 30° and 150°, respectively, intensify the pincushion shape of the frame deflection field on the gun side. Optionally, dependent on the design, the central part of the second rear end section may engage the first rear end section. The two sections may then be connected mechanically so as to increase the mechanical stability.

The invention also relates to a deflection unit for a device as described above.

BRIEF DESCRIPTION OF THE DRAWINGS

The invention will be described in greater detail with reference to the drawings wherein.

DETAILED DESCRIPTION OF THE PREFERRED EMBODIMENTS

Figures 1, 2:
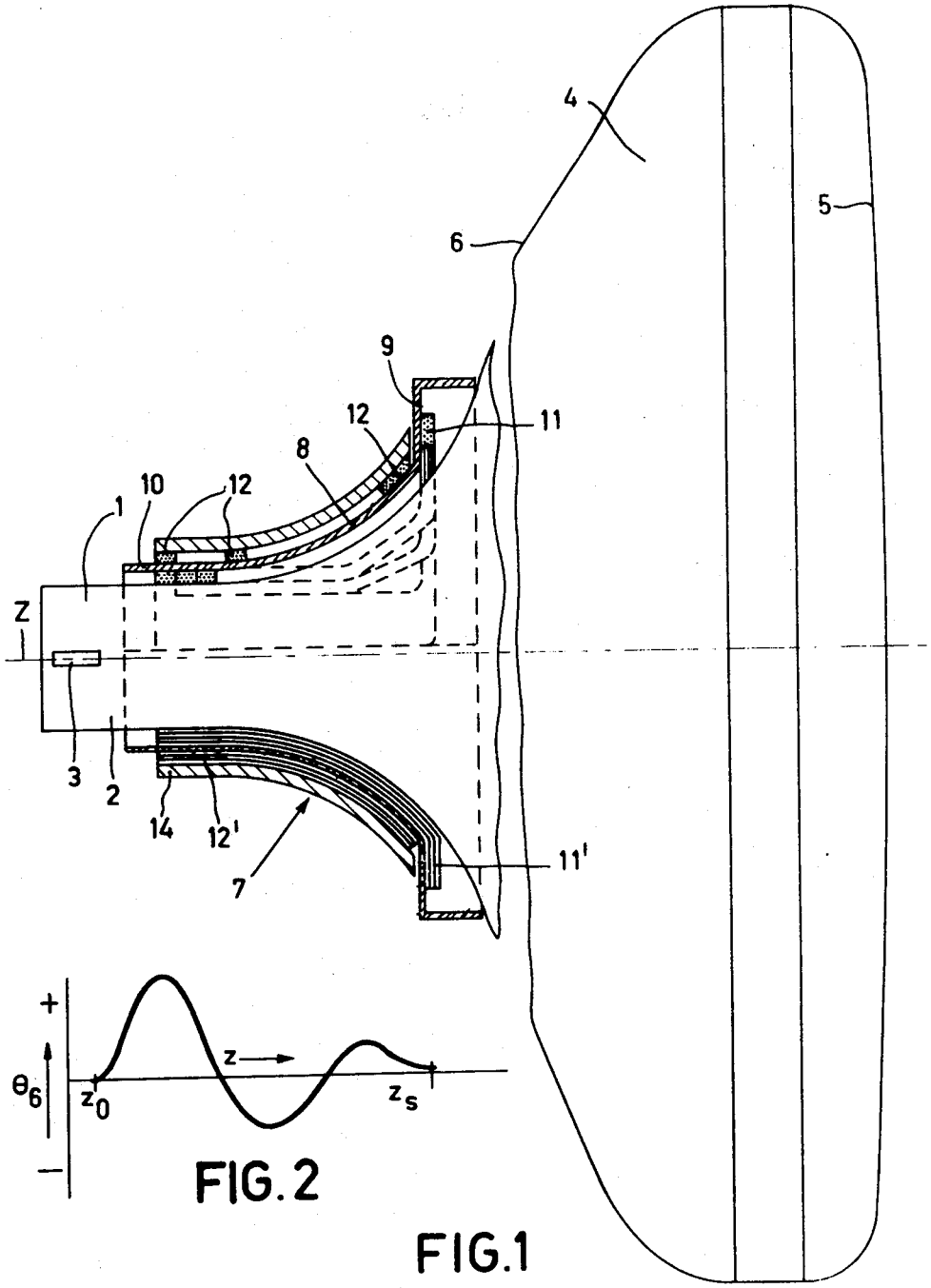
FIG. 1 is a diagrammatic cross-sectional view (taken on the y-z plane) of a display device having a cathode ray tube with deflection unit assembled thereon.
FIG. 2 shows with reference to the parameter $\theta_6$ the sixpole component of a deflection field which is decisive of the extent of pincushion shape and barrel shape, respectively, transverse to the z-axis of a frame deflection field generated by means of a frame deflection coil system characteristic of the invention.

FIG. 1 is a cross-sectional view of a display device comprising a cathode-ray tube 1 having an envelope 6 which changes from a narrow neck portion 2 in which an electron gun system 3 is assembled into a wide cup-shaped portion 4 which comprises a display screen 5. A deflection unit 7 is mounted on the tube at the transition between the narrow portion and the wide portion. Said deflection unit 7 comprises a support 8 of insulating material having a front end 9 and a rear end 10. Between said ends 9 and 10 on the inside of the support 8 is present a deflection coil system 11, 11' for generating a (line) deflection field for deflection in a horizontal direction of electron beams produced by the electron gun system 3 and, on the outside of the support 8, a system of coils 12, 12' for generating a (frame) deflection field for the deflection in the vertical direction of electron beams produced by the electron gun system 3. The deflection coil systems 11, 11' and 12, 12' are surrounded by an annular core 14 of a magnetizable material. The separate coils 12, 12' of the frame deflection coil system which, as the coils 11, 11' of the line deflection coil system, are of the saddle type with downwardly directed rear end sections are wound with inner and outer windows in such manner as to generate deflection fields which satisfy the conditions of the invention.

The invention relates in general to the generation of a frame deflection field having a field construction and field distribution, respectively, as shown in FIG. 2.

FIG. 2 shows with reference to the parameter $\theta_6$ the sixpole component of a (frame) deflection field characteristic of the invention. A positive value of the sixpole component $\theta_6$ occurs on the gun side ($z=z_o$) and on the screen side ($z=z_s$) of the deflection field, a negative value of $\theta_6$ occurs in the central area of the deflection field. As will be described in detail hereinafter, this means that the deflection field on the gun side is pincushion-shaped, is barrel-shaped in the central area and is pincushion-shaped on the screen side.

Figure 3:
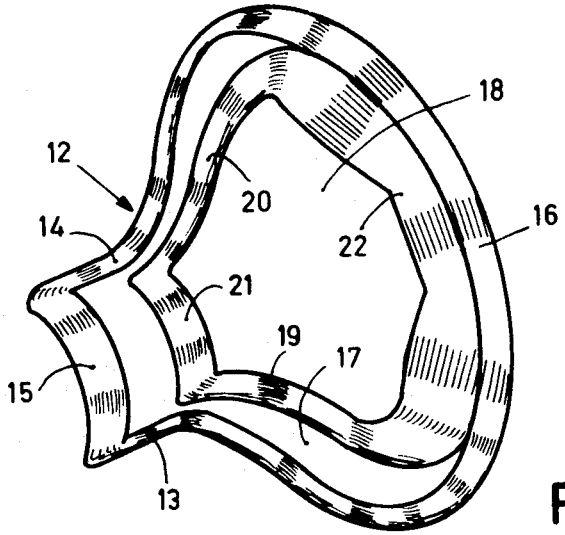
FIGS. 3 and 4 are perspective views each of one coil of a deflection coil system.
Figure 6:
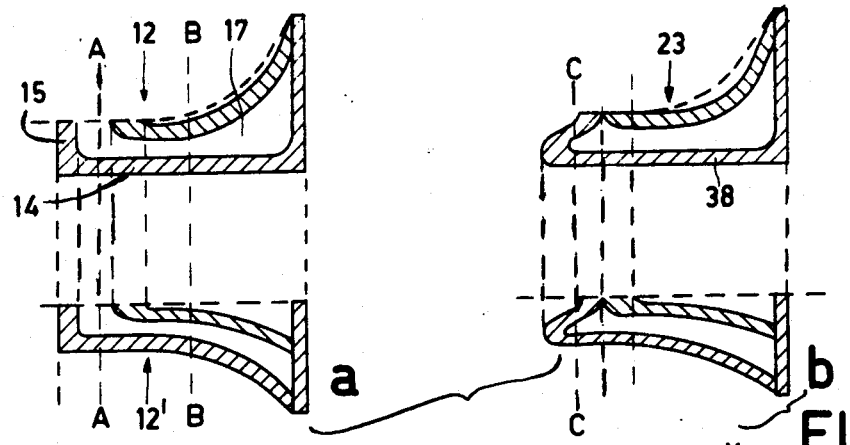
FIG. 6*a* is a sectional view along a plane through the z-axis of a (frame) deflection coil system having coils of the type shown in FIG. 4.
FIG. 6*b* is a sectional view along a plane through the z-axis of a (frame) deflection coil system having coils of the type shown in FIG. 5.

FIG. 3 shows a saddle coil 12 of the frame deflection coil system 12, 12' shown in FIG. 1. Coil 12 is constructed from a first side packet 13 and a second side packet 14 and a first rear end section 15 and a first front end section 16 which together define a window 17. Within the window 17 is a window 18 which is defined by a third side packet 19 and a fourth side packet 20, a second rear end section 21 and a second front end section 22. Coil 12 is manufactured in one winding operation in which first the innermost packet of turns and then the outermost packet of turns is wound. The rear end sections 15, 21 are directed downwards as compared with the front end sections 16, 22. FIG. 6*a* is a cross-sectional view of a frame deflection coil system having two saddle coils of the type shown in FIG. 3. The size of the window aperture of coil 12 on the gun side (the side near end section 15) is determined only by the aperture of the (outer) window 17.

Figure 7:
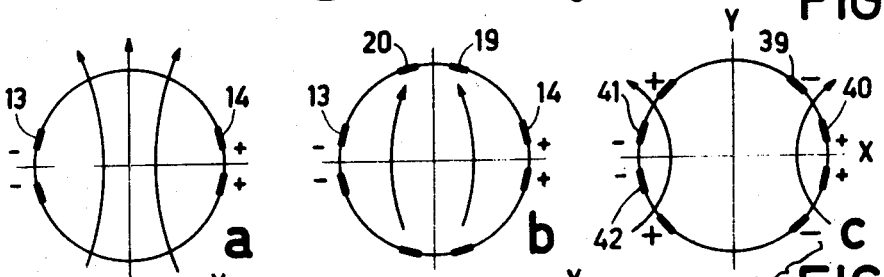
FIG. 7*a* is a cross-sectional view through the coil system of FIG. 6 taken on the line A—A.
FIG. 7*b* is a cross-sectional view through the coil system of FIG. 6*a* taken along the line B—B.
FIG. 7*c* is a cross-sectional view through the coil system of FIG. 6*b* taken on the line C—C.

At that area said window may be made as large as is necessary to generate there a field having the desired extent of pincushion shape. FIG. 7*a* which is a sectional view taken on the line A—A in FIG. 6*a* shows such a generated pincushion distribution, FIG. 7*b* which is a sectional view taken on the line B—B in FIG. 6*a* shows the barrel-shaped field distribution which is generated in the central area of the frame deflection coil system 12, 12'.

Figure 4:
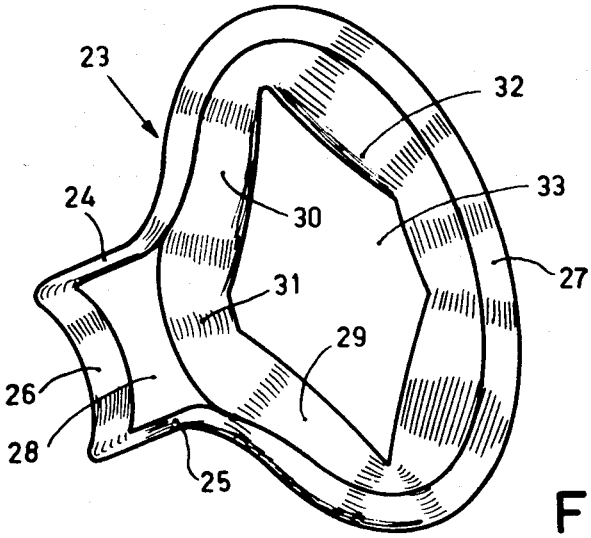

FIG. 4 shows a modified embodiment of coil 12 in FIG. 3. FIG. 4 shows a saddle frame deflection coil 23 having a first and a second side packet 24, 25 and a first rear end section 26 and a first front end section 27 which together enclose a window 28. Deflection coil 23 further has a third and a fourth side packet and a second rear end section 31 and a second front end section 32 which together enclose a window 33 which widens from the rear to the front. Window 33 in this case is so wide on its front that the side packets 25 and 29 and 24 and 30, respectively, engage each other over parts of their lengths. This in contrast with the side packets 17, 19 and 14, 20, respectively, of coil 12 in FIG. 3 which along the circumference occupy positions in which they are separated from each other. With the FIG. 4 type of coil in principle a stronger pincushion-shaped field on the front side can be generated than with the FIG. 3 type of coil.

Figure 5A:
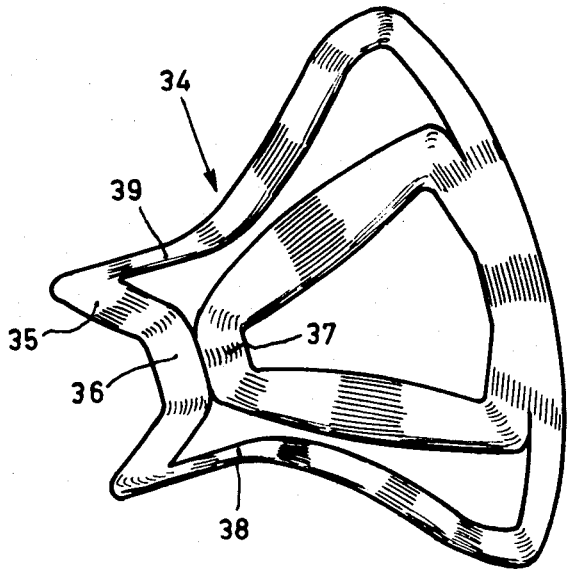
FIGS. 5*a* and 5*b* are perspective views each of one coil of alternative deflection coil systems.

FIG. 5*a* shows another modified embodiment of the the coil 12 in FIG. 3. The saddle frame deflection coil 34 shown in FIG. 5*a* in contrast with coil 12 has a first rear end section 35 the centre 36 of which is situated closer to the second rear end section 37 than the parts adjoining the centre. In this manner loop-shaped segments are formed on the rear side of the side packets 38 and 39 and result in an intensification of the pincushion-shaped deflection field generated on the rear side.

FIG. 6*b* is a cross-sectional view through a frame deflection coil system having two saddle frame deflection coils of the FIG. 5*a* type.

FIG. 7*c* is a cross-sectional view taken on the line C—C through the deflection coil system of FIG. 6*b*. Numeral 39, 40 and 41, 42, respectively, denote the cross-sectional views through the loop-shaped segments which ensure that the deflection field in the situation of FIG. 7*c* is more pincushion-shaped than the deflection field in the FIG. 7*a* situation. The position of the centres of the loop-shaped segments 39, 40 and 41, 42, respectively, is given by the parameter $\phi$. Parameter $\phi$ is preferably substantially 30° and 150° respectively. In other words, the loop-shaped parts centre about radial positions of 30° and 150°, respectively.

Figure 5B:
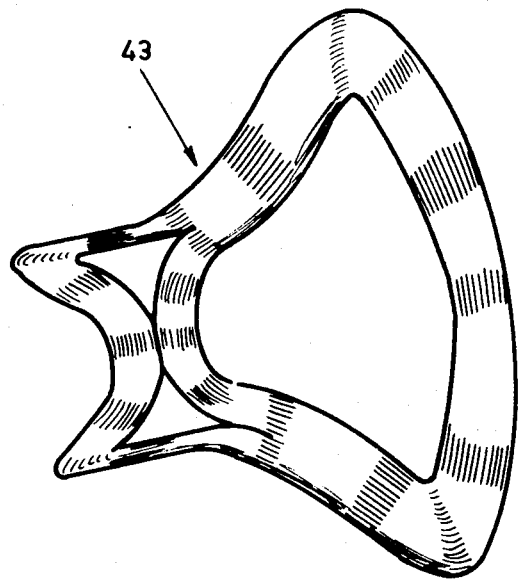

The invention also relates to display devices having saddle frame deflection coils in which the special designs of the coils shown in FIGS. 4 and 5 have been combined. FIG. 5*b* shows such a coil 43.

The extent of barral shape and pincushion shape of a deflection field is determined by the dynamic sixpole component of the deflection field.

This will be explained in greater detail with reference to FIGS. 8, 9 and 10.

Figure 8:
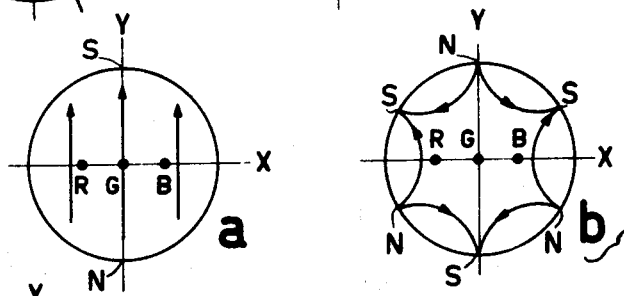
FIGS. 8*a* and 8*b* show the construction of a line deflection field with reference to cross-sectional views through a display tube.

FIG. 8 is a sectional view through a display tube taken along a plane at right angles to the z-axis. Electron beams generated in the display tubes are indicated by R, G and B. The arrows in FIG. 8*a* represent the dipole line deflection field. In the case of the orientation shown of the line deflection field, deflection of the electron beams will take place to the right. The three electron beams are thus in the same plane as in which the deflection takes place. The arrows in FIG. 8*b* represent a sixpole field. The orientation of the sixpole field in FIG. 8*b* *is such that the side beams R and B experience an extra deflection as compared with the central beams in the plane in which they are situated. In such a case the sixpole field is defined as a positive sixpole (line deflection) field. A sixpole field having an orientation which causes the outer beams to experience a smaller deflection than the central beam in the plane in which they are situated, is defined as a negative sixpole (line deflection) field. The sign of a sixpole frame deflection field is defined on the analogy of the comparable situation with a line deflection field.*

Figure 9:
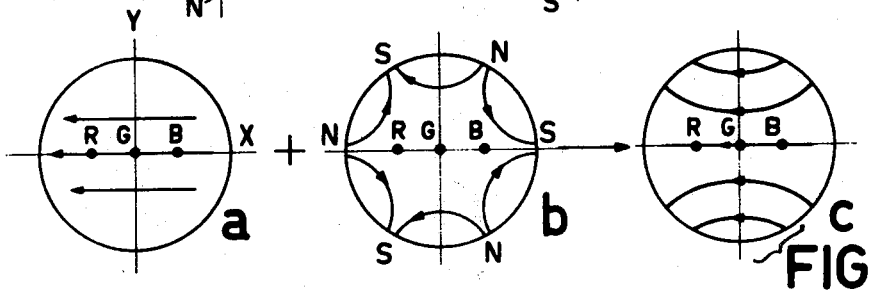
FIGS. 9*a, b* and *c* show, with reference to cross-sectional views through a display tube, the construction of a frame deflection field having a pincushion-shaped distribution.

FIG. 9 is also a sectional view through a display tube along a plane at right angles to the z-axis. The arrows in FIG. 9*a* represent the dipole frame deflection field. In the case of the orientation shown of the dipole deflection field, deflection of the electron beams R, G and B will take place upwards. So in this case the three electron beams are in a plane at right angles to the plane in which the deflection takes place. The arrows in FIG. 9*b* represent a sixpole field. The orientation of the sixpole field in FIG. 9*b* is such that, on the analogy of the comparable situation with a line deflection field (for that comparison FIGS. 9*a* and 9*b* are to be rotated a quarter turn to the right), this sixpole field is termed positive. FIG. 9*c* shows the resulting frame deflection field, which is pincushion-shaped.

Figure 10:
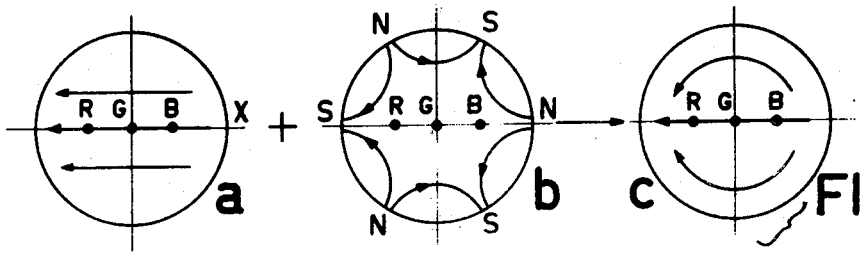
FIGS. 10*a, b* and *c* show with reference to cross-sectional views through a display tube, the construction of a frame deflection field having a barrel-shaped distribution.

FIG. 10 is also a sectional view through a display tube along a plane at right angles to the z-axis. The arrows in FIG. 10*a* represent the dipole frame deflection field. In the case of the orientation shown of the dipole deflection field, the deflection of the electron beams R, G and B will take place upwards. So the three electron beams are in a plane at right angles to the plane in which the deflection takes place. The arrows in FIG. 10*b* represent a sixpole field. The orientation of the sixpole field in FIG. 10*b* is such that, on the analogy of the comparable situation with a line deflection field, said sixpole field is termed negative. FIG. 10*c* shows the resulting frame deflection field, which is barrel-shaped.

What is claimed is:

1. In a device for displaying television pictures comprising a display tube in the neck of which an electron gun system is present for emitting at least one electron beam towards a display screen, and comprising a deflection unit which is mounted coaxially around the display tube, said deflection unit comprising a line deflection coil system which upon energization deflects the electron beam in a first direction and a frame deflection coil system which upon energization deflects the electron beam in a direction transverse to the first direction, said frame deflection coil system comprising two frame deflection coils of the saddle type situated diametrically with respect to each other, each frame deflection coil comprising a number of conductors which are wound so as to produce first and second side packets extending in the longitudinal direction of the deflection unit, an arc-shaped first front end section and an arc-shaped first rear end section which together define a first window the improvement wherein each frame deflection coil also comprises further conductors which are wound to produce third and fourth side packets, an arc-shaped second front end section and an arc-shaped second rear end section which together define a second window which is situated within the first window, said window being shaped to produce, in combination with said first window, a pin-cushion shaped deflection field at the end thereof toward said gun system and a central longitudinal barrel-shaped deflection field.

2. A device as claimed in claim 1, wherein the second window widens towards the front end section.

3. A device as claimed in claim 1 or 2, wherein the central portion of the first rear end section is situated closer to the second rear end section than the parts adjoining the central part.

4. A device as claimed in claim 3, wherein the central part of the first rear end section engages the second rear end section.

5. A device as claimed in claim 1 or 2, wherein the first and second side packets engage the third and fourth side packets over parts of their length.

6. A device as claimed in claim 3, wherein the first and second side packets engage the third and fourth side packets over parts of their length.

7. A device as claimed in claim 4, wherein the first and second side packets engage the third and fourth side packets over parts of their length.

8. The device of claim 1 wherein at least a portion of said first rear end section extends further than said second rear end section, toward said electron gun system.

9. The device of claim 1 wherein said first window extends towards said gun system farther than said second window, whereby a pin cushion-shaped deflection field is produced at the end of said same deflection coils towards said gun system.

10. The device of claim 9 wherein said second window widens toward said display screen.

* * * * *